United States Patent [19]

Kumpfer

[11] 4,398,651

[45] Aug. 16, 1983

[54] MICROWAVE FOOD DISPENSING MACHINE

[76] Inventor: Beverly D. Kumpfer, 4335 Spruce Cir., Salt Lake City, Utah 84117

[21] Appl. No.: 102,921

[22] Filed: Dec. 12, 1979

Related U.S. Application Data

[63] Continuation-in-part of Ser. No. 906,477, Aug. 17, 1978, abandoned.

[51] Int. Cl.[3] ..... G07F 5/00; H05B 6/68

[52] U.S. Cl. ..... 221/6; 221/150 HC; 221/129; 219/10.55 R; 219/10.55 D; 219/10.55 B; 99/357; 99/443 R; 340/825.35

[58] Field of Search ..... 219/10.55 R, 10.55 M, 219/10.55 A, 10.55 B, 10.55 E, 10.55 D, 214; 99/332, 327, 355, 451, 443 R, 448, 357; 194/10; 221/150 R, 150 A, 150 HC, 155, 174, 175, 178, 2, 4, 6, 9, 10, 129; 426/241, 243; 340/825.35

[56] References Cited

U.S. PATENT DOCUMENTS

| | | | |
|---|---|---|---|
| 2,363,724 | 11/1944 | Ford | 99/357 |
| 2,965,005 | 12/1960 | Huchok | 219/10.55 R |
| 2,990,973 | 7/1961 | Chazen | 99/357 X |
| 3,291,035 | 12/1966 | Ignelzi | 99/357 |
| 3,333,666 | 8/1967 | Murray et al. | 219/10.55 R |
| 3,351,741 | 11/1967 | Shelley | 219/214 X |
| 3,381,605 | 5/1968 | Smith | 219/10.55 R |
| 3,386,550 | 6/1968 | Murray et al. | 219/10.55 R |
| 3,397,817 | 8/1968 | Smith | 219/10.55 R |
| 3,416,429 | 12/1968 | Torsiello et al. | 219/10.55 R |
| 3,443,509 | 5/1969 | Sandy | 219/10.55 R X |
| 3,482,509 | 12/1969 | Gardner | 219/10.55 R |
| 3,534,676 | 10/1970 | Rubino | 99/355 |
| 3,606,959 | 9/1971 | Stonor | 221/2 |
| 3,668,357 | 6/1972 | Kobayashi | 219/10.55 D |
| 3,678,238 | 7/1972 | Yasuoka et al. | 219/10.55 D |
| 3,780,907 | 12/1973 | Colburn et al. | 221/2 |
| 3,838,790 | 10/1974 | Naruse | 99/357 X |
| 4,004,712 | 1/1977 | Pond | 219/10.55 B X |
| 4,108,363 | 8/1978 | Susumo | 221/150 HC X |
| 4,217,476 | 8/1980 | Bellavoine | 219/10.55 E |

*Primary Examiner*—B. A. Reynolds
*Assistant Examiner*—Philip H. Leung
*Attorney, Agent, or Firm*—Mallinckrodt & Mallinckrodt

[57] ABSTRACT

An automated food dispensing system is disclosed which uses microwave energy to rapidly heat precooked food items, including complete meals, from low storage temperatures to elevated serving temperatures. Mechanical means are provided to almost instantaneously transport any one of several selectable food items from refrigerated storage compartments into a microwave heating chamber upon insertion of proper coinage or other validation and for automatic delivery of the heated meal or other food item through a delivery chute upon completion of a predetermined heating interval. Container means are provided to prevent the heating of certain food components, such as salads and cold desserts, while rapidly heating other items. Microwave transparent thermal insulation of the food container is provided to permit transportation of the refrigerated food contents with limited spoilage prior to its use and which maintains food items heated therein at elevated temperatures for prolonged periods after dispensing. Means are also provided for remotely determining the inventory status and proper functioning of the heated food dispensing system by telephone or other communications link.

8 Claims, 10 Drawing Figures

MICROWAVE FOOD DISPENSING MACHINE

CROSS-REFERENCE TO RELATED APPLICATIONS

This application is a continuation-in-part of my copending application Ser. No. 906,477 filed Aug. 17, 1978 now abandoned.

BACKGROUND OF THE INVENTION

Microwave ovens have found widespread usage in the food industry for the rapid reconstitution of food items which have been precooked by conventional means, held at storage temperatures until needed for serving, and then rapidly brought to serving temperature in a microwave oven. Several hundred thousand full service restaurants save labor, reduce waste, improve food quality uniformity and increase the speed of seating turn-over by this method of operation. In many cases, multiple retail outlets are supplied from a single centralized food kitchen which manufactures preplated menu items on a production basis for distribution to the remote outlets. Appreciable savings are realized since skilled labor such as chefs is eliminated at the retail outlets, expensive primary cooking equipment is minimized, and food waste is drastically reduced by restocking items only as sold.

Such use of microwave reconstitution of food items by full-service restaurants naturally suggests further streamlining of the system for more casual modes of consumption, such as automatic vending. To date, vending operators have used separate microwave ovens for heating food items dispensed from standard commercial vending machines. This system has suffered from several problems which have limited its practicality:

(a) The public, not being familiar with the use of microwave ovens, has been reticent to attempt their use in a public place.

(b) The microwave oven, being available for unauthorized useage, is used for heating items not obtained from the vending operators machines.

(c) The oven is exposed to abuses by the public such as operation without proper load, or operation with metallic containers such as foil. Such uses seriously reduce the life and reliability of the oven.

(d) The operation of the microwave oven by the public user exposes the vending operator to legal action because of real or alleged harm to the user due to electrical shock or microwave leakage hazards.

It is accordingly an objective of this invention to provide a totally unattended, automated device which avoids all of the above shortcomings.

PRIOR ART DEVICES

Although the prior art shows several prior art devices which are intended to accomplish these ends, (See U.S. Pat. No. 3,534,676, Rubino; U.S. Pat. No. 3,333,666, Murray et al; U.S. Pat. No. 3,416,429 Torsiello et al, etc.) most of these teach no practical means of controlling microwave leakage energy to comply with strict governmental regulations or are unduely costly, bulky, or difficult to service. Some are too large to pass through standard doors.

Therefore, it is an objective of this invention to provide an improved, fully automated, unattended, fast food system utilizing microwave food reheating or reconstitution, which combines the advantages of a full-service restaurant with the economies of a vending system, while avoiding the disadvantages of the latter, as enumerated above.

It is another objective of the invention to provide a simple, reliable, and low cost mechanism for selecting one of a plurality of food items, such as complete meals stored at reduced temperatures and almost instantaneously transporting same to a microwave chamber for rapid heating.

It is another objective of the invention to provide means of automatically dispensing food items and complete meals in a short time from standard 120 volt a. c. wiring service, where desired.

It is a still further objective of the invention to provide a vending machine for rapid dispensing of heated food items, including complete meals, which is easily restocked and serviced.

It is yet another objective of the invention to provide an unattended microwave food dispensing system with provisions which enable an operator or others to determine the status of its inventory and other functioning from remote locations by telephone or other communications link.

Another objective of the invention is to provide a special food container for the automatic food dispensing system which is compatible with its material handling system and which is constructed of a material which is transparent to microwave energy but permits selective heating of some of its contents while maintaining other items in it, such as salads and desserts, at low temperatures, while at the same time providing thermal insulation to permit transportation of refrigerated foods without spoilage and to maintain items heated by the microwave energy at elevated temperatures for prolonged periods after dispensing.

Further objects and advantages of the invention will become apparent from the following description and claims and from the accompanying drawings, wherein:

FIG. 7(*a*) is the container of FIG. 7 in an opened condition.

FIG. 7(*b*) is a cross section of the container of FIG. 7.

DESCRIPTION OF THE INVENTION

Figure 1:
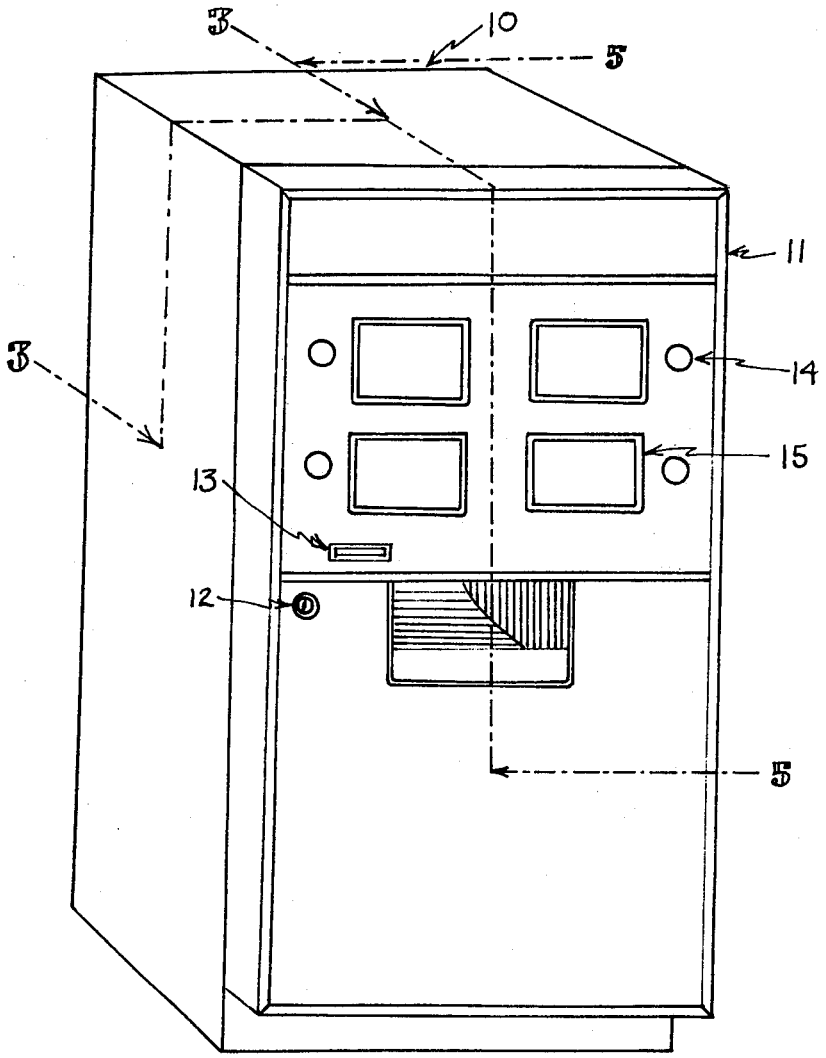
FIG. 1 is a front elevational prespective view of a food heating and vending machine built in accordance with the teachings of the present invention.

The features of my invention can be more readily understood by referring now to FIG. 1 which shows a vending machine constructed in accordance with the teachings of the present invention. An outer cabinet 10 constructed of a material of sufficient strength to protect the contents from the weather and unauthorized access and, preferably prevents the passage of microwave energy, has a hinged door 11 which completes the enclosure of the contents when closed and which incorporates a locking means 12 which engages with cabinet 10 to prevent unauthorized entry when locked. Door 11 also incorporates a currency validator 13 into which proper coinage or other validation may be inserted, a number of push buttons or other selection devices 14 corresponding to the number of food items offered for selection, and item display panels 15 corresponding in number to the number of food item categories available for selection for displaying pictorailly or verbally the items offered for dispensing.

Figure 2:
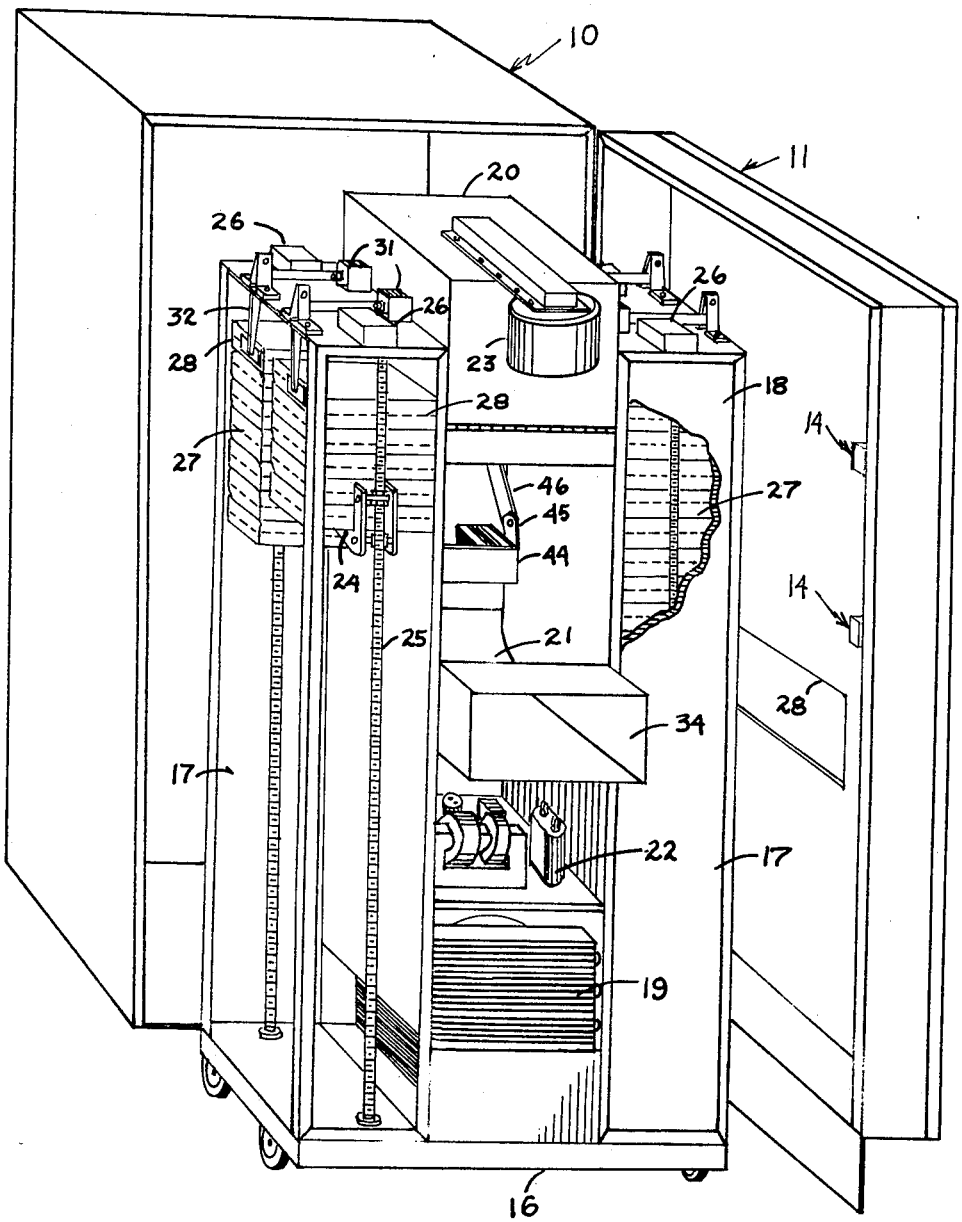
FIG. 2 is a front elevational, diagrammatic view with the front door open and the inner core assembly partially removed.

As shown in FIG. 2, cabinet 10 houses a wheeled, removable, inner core 16 consisting of food storage compartments 17 having insulated walls 18 making them capable of being maintained at reduced temperatures by refrigerater unit 19, a microwave oven cavity 20, a delivery chute 34 and power supplies 22 for powering one or more microwave power generators 23. Each food storage compartment 17 also contains one or more container shelves 24 which are supported by screw jacks 25 which can be rotated upon command by lift motors 26 to elevate container shelves 24 upon which are stacked vertically food containers 27 and 28. The height of the uppermost food container 28 in each stack is determined by limit switches 29, FIG. 3 which disconnect the energizing electrical power to the corresponding lift motor 26 when the height of each uppermost food container 28 is at the level of an inwardly swinging entry door 30 in the wall of microwave oven cavity 20 which is specially constructed for the purpose.

Upon insertion of the proper coinage or other validation, such as tokens, into currency validator 13, selection switches 14 on front door 11 are arranged, i.e. "armed" so that when any selection switch 14 is pressed by a customer, the corresponding uppermost food container 28 is pushed by the corresponding pusher solenoid 31, acting thru pusher arm 32 through entry door 30 and into microwave oven cavity 20. The departure of the uppermost food container 28 from any one of the plurality of food container stacks allows the corresponding stack limit switch 29 to resume its normal position which closes its normally closed contacts to initiate the generation of microwave power in oven cavity 20 by microwave generator 23. The normally closed contact of limit switch 29 also energizes the corresponding stack lift motor 26 which operates to elevate the next food container 27 into the uppermost position to replace the one just injected into the microwave cavity 20 for heating. The time interval required for the next uppermost food container 27 to reach the uppermost position and operate the stack limit switch 29 determines the heating time of the first injected food container 28 and is determined by the speed of the lift motor 26, the pitch of the screw jack thread 25 and the thickness of the food container 28. It will be obvious that this time may be adjusted and extended by delaying the start of lift motor 26.

Figure 3:
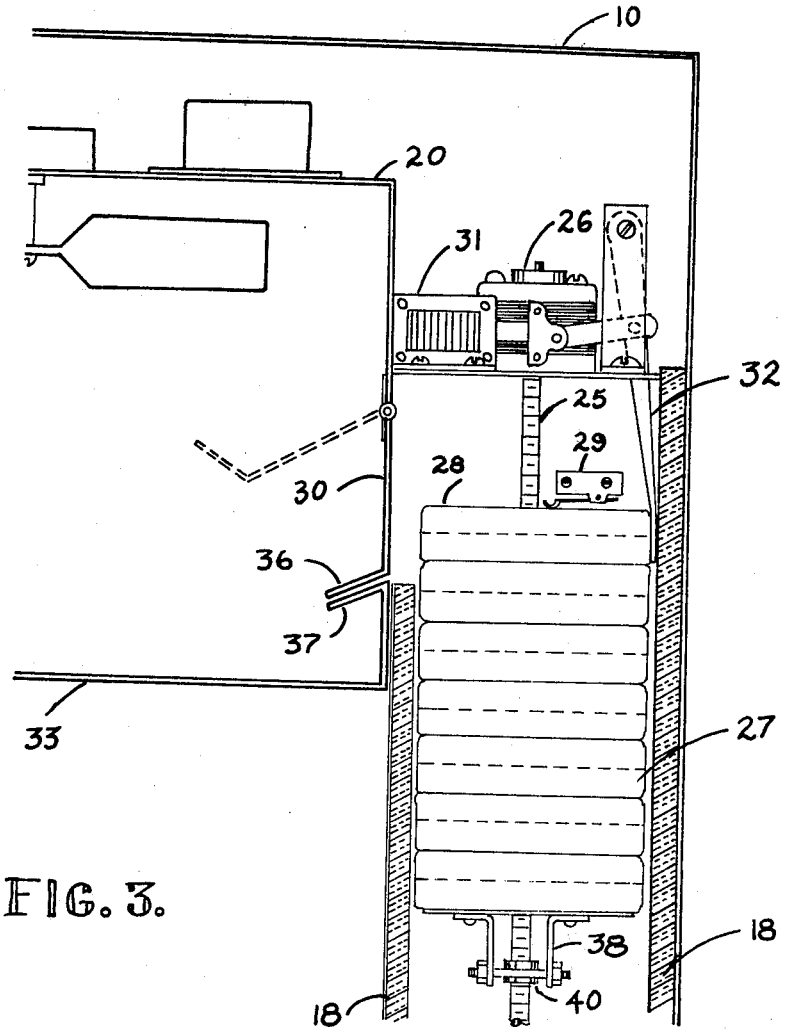
FIG. 3 is a side cross sectional view taken along plane 3—3 of FIG. 1.

When the heating time so determined has elapsed, the heated food in its container 28 is dropped from the microwave oven cavity 20 by hinged bottom 33 FIG. 3 into delivery chute 34 for access by the user.

FIG. 3 is a partial cross sectional view taken along the line 3—3 of FIG. 1 to show in greater particularity the simple and rapid food container transport system described above and where-in similarly functioning parts have similar designations. Inwardly swinging entry door 30 is constructed of a material, such as metal, which does not permit the passage of microwave energy and is fitted with microwave frequency choke means around its free periphery to minimize the escape of microwave energy. One embodiment of such choke means, shown in FIG. 3, is an inwardly projecting lip 36 which is essentially one-quarter wavelength long at the operating frequency and which lies close to, but does not contact, a similar, matching lip 37 which is part of hinged oven bottom 33 to present a very low impedance which serves to substantially attenuate the leakage of microwave energy from oven cavity 20.

Figure 4:
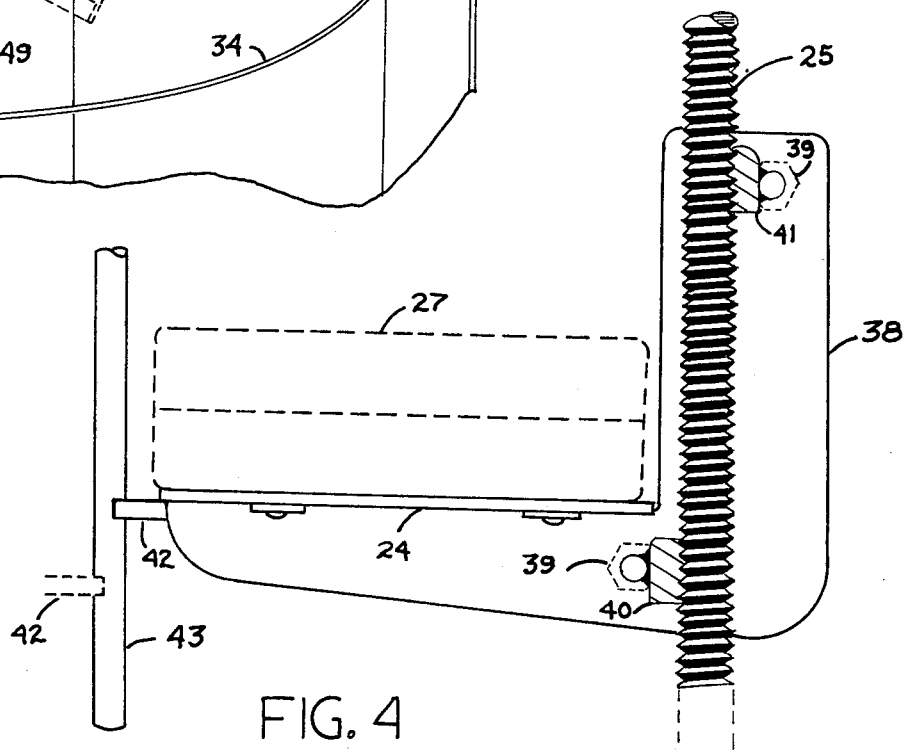
FIG. 4 is a cross-sectional view of the screw-jack food tray support and quick-release mechanism of the present invention.

FIG. 4 makes clearer the constructional details of tray shelves 24 upon which food containers 27 are stacked for elevation to the uppermost position for insertion into the microwave oven cavity 20. Two rigid "L"-shaped plated 38 are spaced on either side of screw jack shaft 25 by spacers 39 to which are affixed a lower half-nut 40 and an upper half-nut 41 each having a thread matching in diameter and pitch the diameter and pitch of screw jack shaft 25. A shelf 24 is affixed to plates 38 for the support of meal containers 27. When shelf 24 is loaded, the mass of the food containers 27 produces a downwardly acting torque which acts to increase the engagment of half-nuts 40 and 41 with the threads of screw jack shaft 25. The greater the weight of food containers 27 on shelf 24, the greater the force of the engagment produced. When it is desired to lower the tray shelves 24 upon screw jack shafts 25, as when it is necessary to restock the supply of food containers 27, they may be readily lowered by applying an upwardly acting torque to shelf 24 which disengages the half nuts 40 and 41 with the threads of screw jack shaft 25. Thus a quick release for the food container shelves 24 is provided to facilitate rapid restocking of the food vending machine of the present invention. Rotation of the food container shelves 24 due to the rotation of jack screws 25 is prevented by the sliding engagment of shelf guide 42 affixed to food container shelf 24 with guide-rod 43 which is permanently attached at its extremities to the top and bottom surfaces of low temperature food compartments 17.

Figure 5:
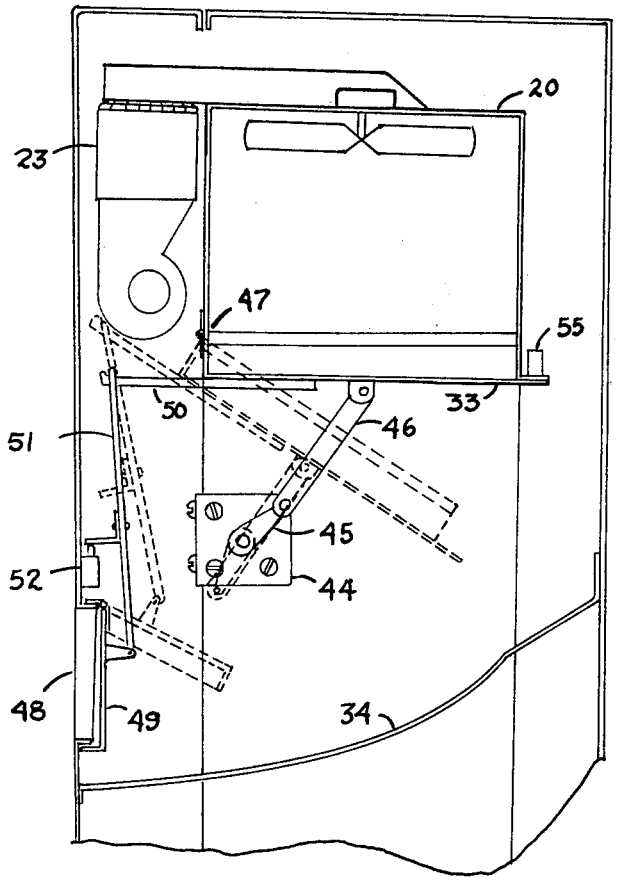
FIG. 5 is a cross sectional view taken at plane 5—5 of FIG. 1.

FIG. 5 is a partial cross-sectional view taken along plane 5—5 in FIG. 1 to show the functioning of my invention after microwave heating has been completed. This heating time is predetermined as described above by the interval required for the next upper most meal container 27 in the stack from which the food item being heated was selected to be elevated to the uppermost position 28 by screw jack 25 so as to operate the corresponding limit switch 29 which completes a serially connected circuit through the normally open contacts of all such switches 29 to operate drop motor 44 which rotates crank 45 to operate linkage 46 to lower oven bottom 33 which is hinged at 47 to its drop position indicated by phantom lines in FIG. 5. The meal container 28 which has thus been heated is slid out of oven 20 toward the rear of the vending machine by gravity and onto delivery chute 34 where it slides to a position toward the front of the machine for access by the user. This drop system provides a long drop which is advantageous in preventing theft of food containers 27 by reaching through door aperture 28, through oven cavity 20 and into food stacks 17. Aperture 48 in door 11 may be open or, in the preferred embodiment of FIG. 5, may incorporate a door 49 for further controlling the escape of microwave energy. Door 49 is automatically actuated by a lever arm 50 affixed to and an extension of oven bottom 33 through linkage 51 to open door 49 at the time meal container 28 is dropped into delivery chute 34. An interlock switch 52 is operative to prevent the generation of microwave energy when drop chute door 49 is open.

Figure 6:
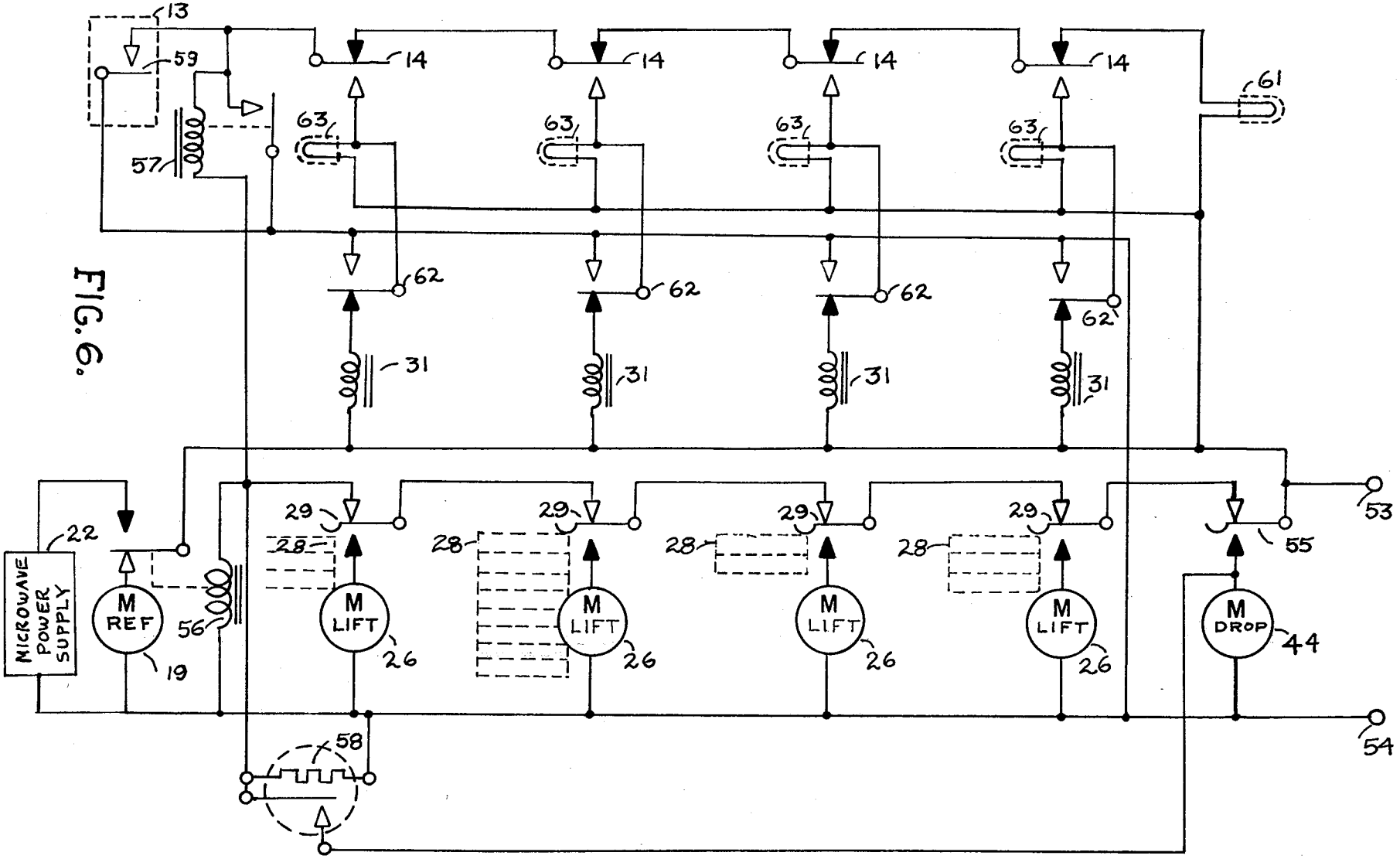
FIG. 6 is a schematic diagram of the electrical circuits which perform the timing sequence logic and control functions of the automatic meal dispensing machine.

FIG. 6 shows the details of the electrical logic circuit associated with the operation of the mechanical system described above. Line power is connected to input terminals 53 (high) and 54 (neutral). Single pole, double throw switch 55 is actuated by oven bottom 33 so that its normally open contact is closed when the oven bottom 33 is in its closed position, placing line power on the serially connected normally open contacts of stack limit switches 29 so that if uppermost food containers 28 occupy that position in all meal stacks in refrigerated storage compartments 17, the series circuit so formed contents line power to the coil of relay 56, the coil of the coin, token or bill validator latching relay 57 and the delay element of time delay relay 58, causing its normally closed contacts to open. Operation of relay 56 places line power from terminal 53 on the compressor of refrigeration unit 19 and removes it from microwave power unit(s) 22 to prevent concurrent operation of both microwave power unit(s) 22 and refrigeration unit 19 so as to prevent their exceeding the line current available from normal wiring service such as 120 volt, 20 ampere house wiring.

This is the condition of the circuit of my invention in its "Ready" state. Still referring mainly to FIG. 6, the proper sequence of events which occur during an operation cycle of the food dispensing machine is as follows:

(a) Upon insertion of proper coinage, paper currency, or tokens, the validator 13 which may, for example be a National Rejectors "BUCKPASSER" of U.S. paper dollars, is operational to provide a momentary closure of its normally open (N.O.) contact 59 which completes a circuit from neutral terminal 54 through the coil of relay 57 and back to the high side of the line 53 through serially connected stack limit switches 29. Momentary closure of relay coil 57 causes it to latch closed after the opening of validator contacts 59 and remain latched so long as the series connected stack limit switches 29 N.O. contacts are all maintained closed to supply line voltage to the coil of validator latching relay 57. Latching of the arming or validator relay 57 also places a power line neutral from terminal 54 on the common contact of the first of a chain of snap action single pole, double throw item selection switches 14 which are series connected so that the N.C. contact of each is connected to the common contact of the next to form a continuous circuit to light indicator light 61 on the front door 11 to indicate to a user that validation is complete and that a selection may be made. The machine is thus "Armed".

(b) When any selector switch 14 is depressed to indicate a food item preference, its corresponding pusher solenoid 31 is energized by connecting the neutral from the latched arming relay 57 through the now closed N.O. contact of the selector switch 14, through the N.C. contact of product "out" switch 62 to complete the circuit through the pusher solenoid 31 and back to the high side line terminal 53.

(c) The mechanical force produced by the activation of solenoid 31 acting through mechanical linkage 32 (FIG. 3) pushes the uppermost meal container 28 almost instantaneously from the corresponding food storage compartment 17 into the microwave oven cavity 20 through pendulous door 30.

(d) The removal thus of the uppermost food container 28 from any food stack causes the corresponding stack limit switch 29 to restore to its N.C. position and break the circuit through the chain of N.O. contacts of stack limit switches 29 to remove line power from the arming relay 57 to unlatch it and remove line power neutral from the select switch 14 series chain so that further item selection and insertion is prevented. The restoration of stack limit switch 29 to its N.C. condition upon insertion of uppermost meal container 28 also removes line power from relay 56 to cause it to restore to its N.C. contact to actuate the microwave power supply 22 to effect the rapid heating of the food in food container 28 which was injected into oven cavity 20 and to remove line power from the refrigerator compressor 19. The removal of the selected uppermost food container 28 from its corresponding stack also permits the restoration of the corresponding stack limit switch 29 to close its N.C. contact to actuate its corresponding lift motor 26, acting through its screw jack 25 to elevate the corresponding shelf 24 to cause the next uppermost food container 27 to automatically replace the injected uppermost food container while the injected container 20 is being heated. The restoration of any stack limit switch 29 to its N.C. contact caused by the insertion of any uppermost meal container 28 also removes line power from the thermal element of time delay relay 58, causing its contacts to restore to its normally closed position during the time interval required to heat the inserted meal in the microwave cavity 20.

(e) Upon the elapse of the heating time determined as described above, the next uppermost food container 27 has been elevated to the uppermost position adjacent to pendulous entry door 30 at the height determined by stack limit switch 29 which is operative to stop its respective lift motor 26 and reestablish the serial connection through the N.O. contacts of all stack limit switches 29 to again place line power from terminal 53 on relay 56 to terminate the generation of microwave power by power supplies 22 and also to restore operation of refrigeration compressor 19.

(f) The "Drop" cycle is also initiated when the next uppermost food container 27 is elevated to the uppermost position to operate stack limit switch 29 which again completes the series circuit through the N.O. contacts of all stack limit switches 29 to connect line power to the drop motor 44 through the N.C. contacts of time delay relay 58 which has a delay time of the several seconds required to permit the oven bottom snap action switch 55 to operate to its N.C. contacts to assume the operation of drop motor 44 which acts through crank mechanism 45 and 46 to lower oven bottom 33 to its lowered position (as indicated by phantom lines in FIG. 5) to drop the heated food in its container 38 into delivery chute 34. The drop cycle is completed when the hinged oven bottom 33 closes to restore oven bottom snap action switch 55 to its N.O. condition to stop the action of drop motor 44 and place power from line terminal 53 on the serially connected stack limit switches 29 to operate relay 56 and place the system in a condition to repeat the vend cycle.

(g) If all food containers 27 and 28 are depleted from a given food container stack, the elevation of the empty container support shelf 24 (FIG. 3) to its uppermost position in that stack operates double throw, single pole switch 62 to its N.O. position to disable its corresponding pusher solenoid 31 and illuminate corresponding "Out" indicator light 63 to indicate to a prospective buyer that the corresponding food selection is sold out. The "Out" light 63 may appear on the front of door 11 as a separate indicator or, in a preferred embodiment of my invention, be incorporated in the selection switch 14.

Figure 7A:
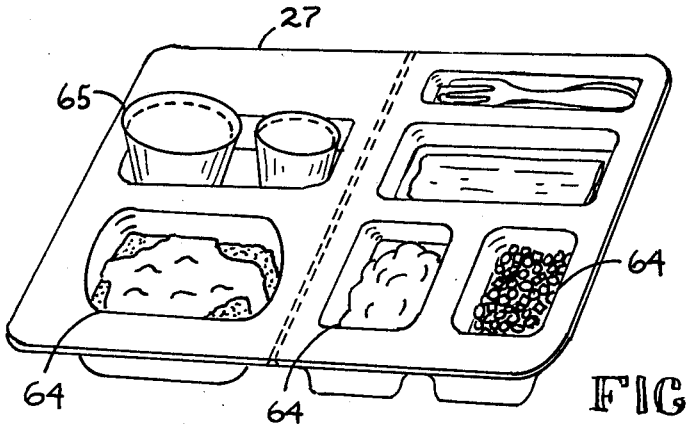
FIG. 7 illustrates the thermally insulated food container used with the microwave vending machine of the present invention.
Figure 7:
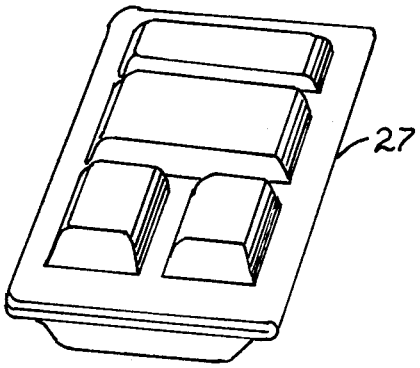
Figure 7:
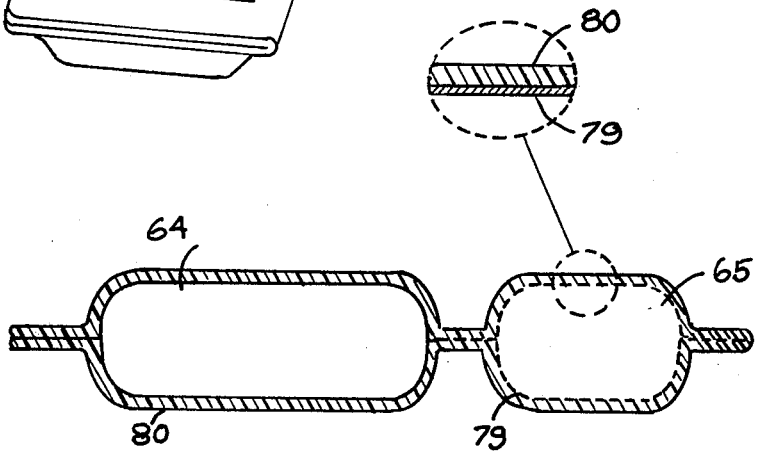

FIG. 7 illustrates the design details of the special food container 27 designed for use with the automated food dispensing system of the present invention. Such container means may be constructed of styrofoam, paper or other suitable material which is transparent to microwave energy but has good thermal insulating properties so as to permit the transportation of refrigerated foodstuffs for short durations of time with minimal spoilage without external refrigerating means and also to enable food items heated therein to be transported or held for times up to about one hour without appreciable loss of heat.

Food container 27, 28 may include compartments 64 for food items such as meat, vegetables and starches to be heated within microwave cavity 20 and other compartments 65 which are enclosed in a material 79, such as metal foil, which is not permeable by microwave energy for the inclusion of food items not requiring heating, such as green salads, slaws and cold desserts. Such shielded compartments 65 may be produced by laminating microwave-reflecting material 79 within the microwave transparent and thermally insulating material 80 as illustrated in FIG. 7*b*, or may be containers which are separate but contained within food container 27 as shown in FIG. 7. It will be obvious that microwave-reflecting material 79 may be laminated on the inside, the outside, or between layers of microwave transparent material 80. Contrary to popular belief, the introduction of metallic objects into a microwave oven is permissable provided that there is sufficient microwave absorbing material, such as the foodstuffs in compartments 64, to absorb an appreciable portion of the microwave energy produced by microwave generators 23.

Figure 8:
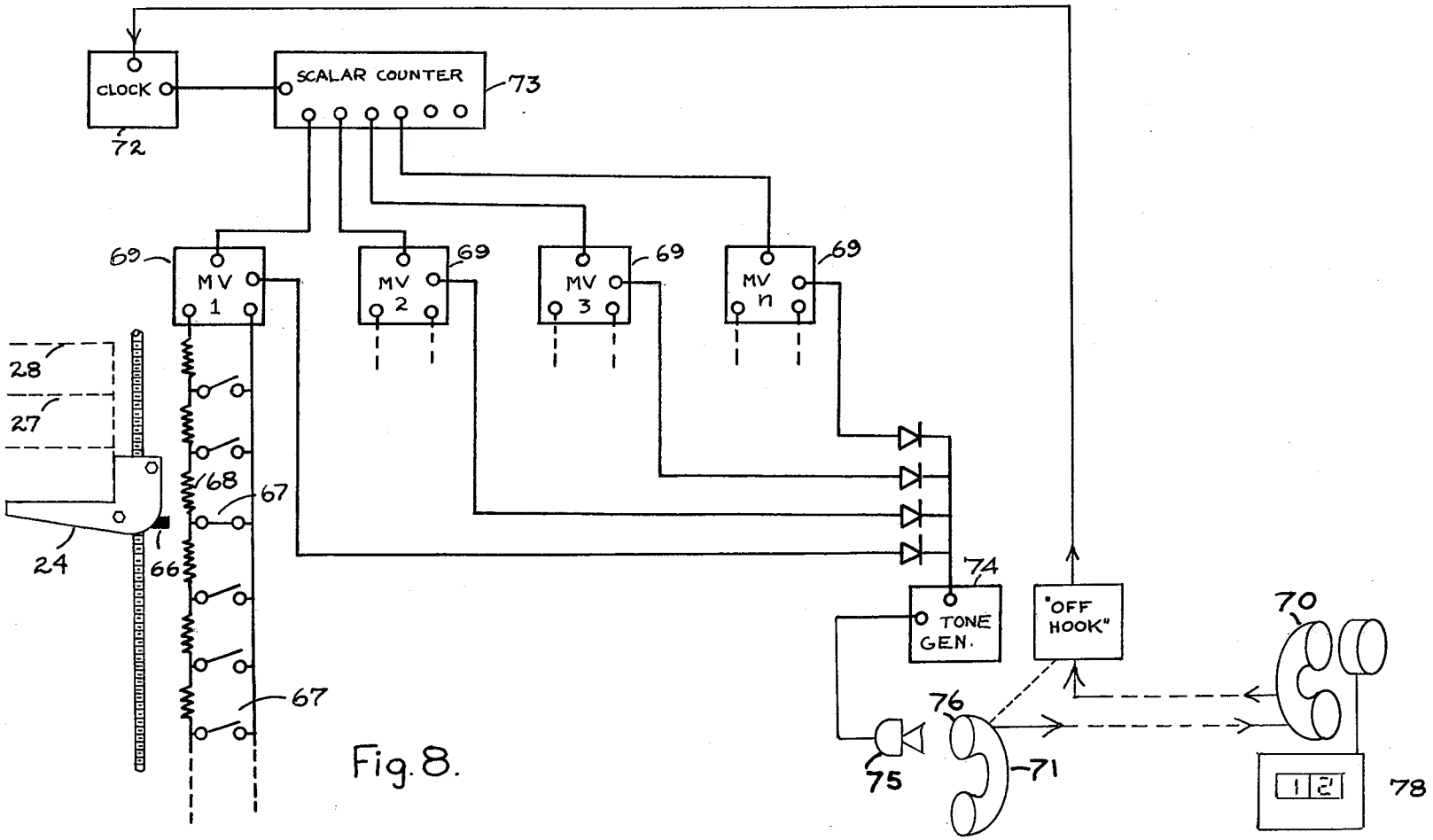
FIG. 8 illustrates the elements of the remotely monitored inventory system incorporated into the vending system.

FIG. 8 illustrates the feature of the present invention which enables the inventory and conditions, such as storage compartment temperature, to be determined from a remote location via a land-line such as public telephone, or by other communications link such as radio. The outputs of transducers indicating these variables in either analogue or digital form are sampled in a predetermined time sequence by a mechanical or electronic commutator and are suitably processed for transmission to a remote point for decoding and display. The sequence may be initiated by an incoming signal such as the ringer signal, or may be continuously available for interrogation seriatim by an incoming call. In the preferred embodiment of FIG. 8, the transducers for food container inventory determination comprise magnetic reed switches 67 in a linear arrangement adjacent to food container stacks 27, 28 so that magnets 66 affixed to each food container shelf 24 actuates the adjacent reed switch 67, which corresponds to the height of the food container shelf 24 above the floor of low temperature compartment 17 and is therefore proportional to the number of food containers 27,28 removed from or remaining in the food container inventory. The actuation of the reed switch 67 corresponding to a given height of the food container shelf 24 connects a resistor 68 into the R-C circuit of a free running multivibrator 69 to adjust its output pulse frequency to correspond to the correct inventory number when sampled for the fixed clock interval. In operation, an incoming call from remote telephone 70 initiates an off-hook condition at handset 71 by means which are well known and initiates operation of clock signal 72, which produces pulses of the desired sampling duration. These pulses are applied to scalar counter 73 which operates multivibrators 69 seriatim and in a predetermined sequence for a fixed time interval determined by clock 72. The sequential pulse trains from transducer multivibrators 69 are then applied to tone generator 74 which converts the pulse trains to tone frequencies of, for example, 1000 Hz. for acoustic transmission by acoustic transducer 75 which is coupled to handset transmitter 76 which transmits the tone pulse trains to remote handset 70 where they are counted either audibly or by electronic counting means 78 which is known to the art. Since the pulse rates of multivibrators 69 are adjusted by the resistor 68 selected by reed switches 67 to correspond to the proper inventory number when sampled for the period of clock 72, the number registered by counter 78 will correspond to the number of food containers 27 and 28 removed from, or remaining, the corresponding food container stack. One sampling channel is provided for each food container variety contained in the unattended food dispensing machine of the present invention. Other qualities, such as the temperature of the low temperature food storage compartments, may also be encoded by additional channels and transducers for decoding at a remote location.

The reed switch transducers 67 and associated resistors 68 may be located external to the refrigerated food storage compartments 17 for operation through non-ferrous insulating material by the magnetic fields of magnets 65 attached to food container trays 24 inside of food storage compartments 17.

Other electronic means of accomplishing the above described remote inventory monitoring function, such as counting and registering the number of times pusher solenoids 31 are activated to propel an uppermost food container 28 into microwave oven 20 will be obvious. Likewise, other features of the invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. In an unattended automatic food vending system, comprising an outer, microwave-confining cabinet containing a microwave oven having at least one microwave-confining entry door through which packaged food containers may be introduced for heating and an exit door to permit said food containers to be delivered after heating; a delivery chute for said food containers; a delivery opening in said cabinet permitting access to food containers in said delivery chute; one or more low-temperature storage compartments within said cabinet adjacent to said microwave oven for receiving food containers constructed of material which is transparent to microwave energy but which is an effective thermal insulator, and which may contain microwave-shielded compartments; conveying means within said one or more storage compartments and having shelves for supporting said food containers in one or more vertical stacks; means for automatically positioning the uppermost of said food containers in said one or more vertical stacks adjacent to corresponding ones of said entry doors of said microwave oven; propulsion means operative to move any selected uppermost food container through a corresponding one of said entry doors and into said microwave oven; and electrical logic circuitry operative to initiate microwave power generation upon the entry of a selected food container into said oven and to initiate operation of said exit door of the oven after completion of a predetermined heating interval; the improvement wherein there are provided electronic means for the remote determination of food inventory by electronically counting the number of food containers remaining in or depleted from the container stacks and by transmitting the count to a remote location upon interrogation by a signal from said remote location or as internally generated, said electronic means including magnets affixed to the food container shelves, respectively; and respective magnetic reed switches disposed along the direction of travel of the conveying means, said switches being operative to produce electrical analogue signals proportional to the height of the resepctive food container shelves and hence proportional to the number of said food containers remaining in or removed from the food container stacks.

2. In an unattended automatic vending system as set forth, the improvement of claim 1 wherein the electronic means further includes means for processing the analoque signals for transmission seriatum to a remote location via a communication system.

3. In an unattended automatic food vending system, comprising an outer, microwave-confining cabinet containing a microwave oven having at least one microwave-confining entry door through which packaged food containers may be introduced for heating and an exit door to permit said food containers to be delivered after heating; a delivery chute for said food containers; a delivery opening in said cabinet permitting access to food containers in said delivery chute; one or more low-temperature storage compartments within said cabinet adjacent to said microwave oven for receiving food containers constructed of material which is transparent to microwave energy but which is an effective thermal insulator, and which may contain microwave-shielded compartments; conveying means within said one or more storage compartments and having shelves for supporting said food containers in one or more vertical stacks; means for automatically positioning the uppermost of said food containers in said one or more vertical stacks adjacent to corresponding ones of said entry doors of said microwave oven; propulsion means operative to move any selected uppermost food container through a corresponding one of said entry doors and into said microwave oven; and electrical logic circuitry operative to initiate microwave power generation upon the entry of a selected food container into said oven and to initiate operation of said exit door of the oven after completion of a predetermined heating interval; the improvement wherein the conveying means are screw jacks in the form of threaded rods with said low temperature storage compartments, each threaded rod being held in alignment by fixed bearings at its extremity, being free to be rotated upon command by motor means, and supporting the shelves upon which said food containers may be disposed, said shelves being attached to corresponding ones of said threaded rods by nuts which are secured to said shelves, so as to provide mechanical support for said shelves and the received food containers; motor means for rotating said threaded rods to elevate said food containers for introduction of the uppermost thereof into said oven; and means for limiting the extent of elevation of said containers.

4. The improvement of claim 3, wherein the nuts for each shelf comprise an upper halfnut having threads engaged with the threads of the corresponding threaded rod at the side of said rod away from the shelf, and a lower half-nut having threads engaged with the threads of said rod at the same side of the rod as the shelf, so that shelf load produces a torque which increases thread engagment but permits the shelves to be readily disengaged from the threaded rods, for rapid lowering to replenish the stock of food containers, by lifting said shelves in a direction opposite said torque to disengage nut and rod threads.

5. The improvement set forth in claim 3 wherein the microwave oven has heated-meal delivery means; and the controlling means also includes switch means positioned for operation by said heated-meal-delivery means for reactivating said controlling means for a new cycle of apparatus operation.

6. In an unattended automatic food vending system, comprising an outer, microwave-confining cabinet containing a microwave oven having at least one microwave-confining entry door through which packaged food containers may be introduced for heating and an exit door to permit said food containers to be delivered after heating; a delivery chute for said food containers; a delivery opening in said cabinet permitting access to food containers in said delivery chute; one or more low-temperature storage compartments within said cabinet adjacent to said microwave oven for receiving food containers constructed of material which is transparent to microwave energy but which is an effective thermal insulator, and which may contain microwave-shielded compartments; conveying means within said one or more storage compartments and having shelves for supporting said food containers in one or more vertical stacks; means for automatically positioning the uppermost of said food containers in said one or more vertical stacks adjacent to corresponding ones of said entry doors of said microwave oven; propulsion means operative to move any selected uppermost food container through a corresponding one of said entry doors and into said microwave-oven; and electrical logic circuitry operative to initiate microwave power generation upon the entry of a selected food container into said oven and to initiate operation of said exit door of the oven after completion of a predetermined heating interval; the improvement wherein the propulsion means comprise electrical solenoid actuators mounted externally of said low temperature storage compartments; mechanical linkages extending within said low temperature storage compartments and arranged so as to couple said actuators to the uppermost food container so that, upon actuation of any one of said electrical actuators, the selected uppermost food container is rapidly propelled through the corresponding entry door into the microwave oven, each mechanical linkage comprising a lever arm pivotally mounted at its uppermost end, fulcrumed externally of the corresponding low temperature storage compartment, and mechanically coupled to said solenoid actuator between the fulcrum point and the lower extremity of said lever arm, so that actuation of said solenoid actuator upon the selection of the corresponding uppermost meal container causes an arcing excursion of the lower extremity of said lever arm of sufficient force and extent to propel said uppermost selected food container into the microwave oven for heating.

7. In an unattended automatic food vending system, comprising an outer, microwave-confining cabinet containing a microwave oven having at least one microwave-confining entry door through which packaged food containers may be introduced for heating and an exit door to permit said food containers to be delivered after heating; a delivery chute for said food containers; a delivery opening in said cabinet permitting access to food containers in said delivery chute; one or more low-temperature storage compartments within said cabinet adjacent to said microwave oven for receiving food containers constructed of material which is transparent to microwave energy but which is an effective thermal insulator, and which may contain microwave-shielded compartments; conveying means within said one or more storage compartments and having shelves for supporting said food containers in one or more vertical stacks; means for automatically positioning the uppermost of said food containers in said one or more vertical stacks adjacent to corresponding ones of said entry doors of said microwave oven; propulsion means operative to move any selected uppermost food container through a corresponding one of said entry doors and into said microwave oven; and electrical logic circuitry operative to initiate microwave power generation upon the entry of a selected food container into said oven and to initiate operation of exit door of the oven after completion of a predetermined heating interval; the improvement wherein the bottom of the microwave oven is hinged along one side as the exit door and is sealed against microwave leakage along its remaining sides when in a first closed position, said door being free to be lowered to an inclined, second, open position and then returned to its first closed position; wherein power means are provided for operating said door, said delivery opening being located in the front of the cabinet, the hinged side of said door being toward the front of the microwave oven so that food containers heated by said oven are slid toward the rear of said cabinet when said door assumes its second open position, and said delivery chute extending from a receiving position rearwardly of said door to said delivery opening, so that said food containers reverse direction of movement and are directed toward the front of the cabinet to provide a circuitous path to prevent the unauthorized access to the microwave oven and said storage compartments.

8. In a coin-controlled apparatus for dispensing hot meals, which apparatus comprises means for storing, under low temperature conditions, meals individually packaged in a manner susceptible of heating in a microwave oven; a microwave oven; respective means for selecting a packaged meal, for introducing the selected meal into the microwave oven, and for providing customer access to said selected meal as heated by the oven; and coin-activated means for controlling said respective means in timed sequence; the improvement wherein the means for introducing the selected meal to the microwave oven comprises means within said low temperature storage means for receiving one or more stacks of packaged meals to be heated and dispensed and for elevating the respective stacks, meal by meal, to a position for introduction of the uppermost meal of each stack into said oven; wherein the controlling means includes limit switch means positioned above said one or more stacks for actuation, respectively, by the uppermost meals in the respective stacks and for reactivation by the next lower meals as they rise to oven-introducing positions following oven-introduction of the immediately preceeding uppermost meals of the stack; and wherein such controlling means is arranged to activate customer-selected meal introduction into said oven and, then, to effect meal heating in said oven and customer access to the heated meal under the control of said limit switch means, so that said meal heating and customer access are carried out within the interval of time between introduction of a meal into said oven and positioning of the next lower meal for introduction into said oven.

* * * * *